US005108356A

United States Patent [19]

Rickenbach

[11] Patent Number: 5,108,356

[45] Date of Patent: Apr. 28, 1992

[54] ONE STEP PULL TAB CAP-LINING MACHINE

[75] Inventor: Newton Rickenbach, Mesa, Ariz.

[73] Assignee: Top Seal Corporation, Phoenix, Ariz.

[21] Appl. No.: 481,064

[22] Filed: Feb. 16, 1990

[51] Int. Cl.[5] ..... B21D 51/46

[52] U.S. Cl. ..... 493/353; 413/63

[58] Field of Search ..... 493/76, 79-81, 493/344, 353; 413/63, 64; 72/326, 327

[56] References Cited

U.S. PATENT DOCUMENTS

| | | | |
|---|---|---|---|
| 1,306,920 | 6/1919 | Miller | 493/353 |
| 4,328,905 | 5/1982 | Hardt | 220/258 |
| 4,341,498 | 7/1982 | Ellis | 413/64 |
| 4,544,080 | 10/1985 | Wright et al. | 220/270 |
| 4,728,239 | 3/1988 | Kieran et al. | 413/63 |
| 4,754,890 | 7/1988 | Ullman et al. | 215/232 |

FOREIGN PATENT DOCUMENTS

| | | | |
|---|---|---|---|
| 578997 | 7/1959 | Canada | 493/81 |

*Primary Examiner*—D. S. Meislin
*Assistant Examiner*—Jack Lavinder
*Attorney, Agent, or Firm*—LaValle D. Ptak

[57] ABSTRACT

A cap-lining machine is disclosed for producing cap liner inserts of the type used to provide a tamper evident seal on the tops of bottles and other containers. To facilitate removal of this seal, it is desirable to have a tab attached to one edge of the seal which can be grasped to pull the seal off the top of the bottle. The liner insert, with an attached tab, is formed in one step by a mating punch and die, each having first and second portions corresponding to the primary portion of the cap insert and the tab, respectively. The structure of the punch and die is such that the tab first is formed and then is folded beneath the main portion of the cap insert in a single operation. The punch includes a reciprocating tamper inside the main portion for pushing the cap insert, with the folded under tab, into a cap located beneath the punch.

8 Claims, 1 Drawing Sheet

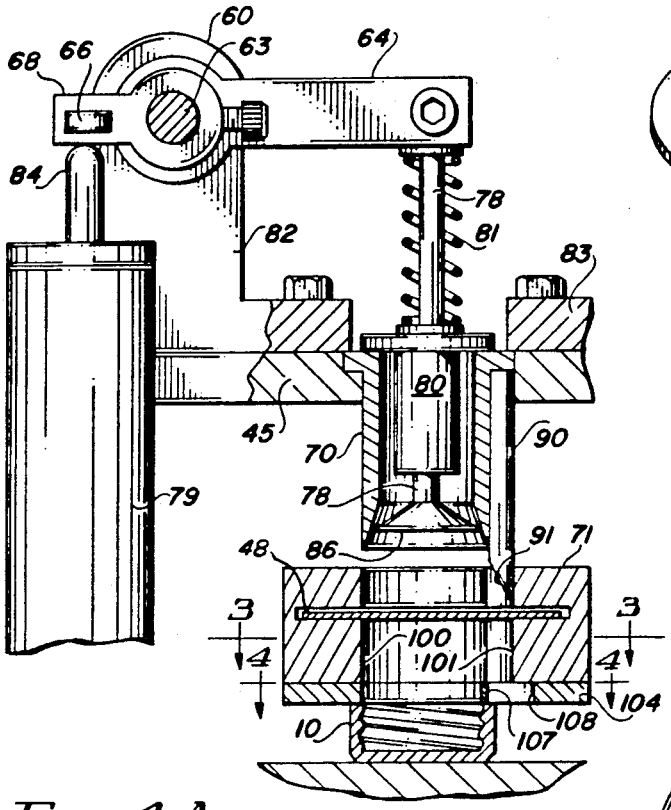
FIG. 1A
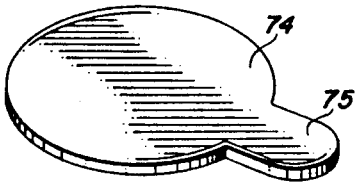
FIG. 2
FIG. 3
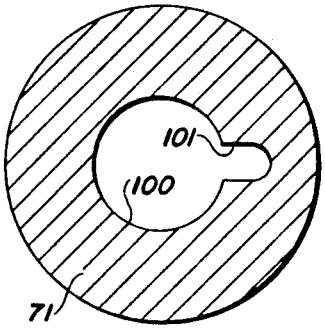
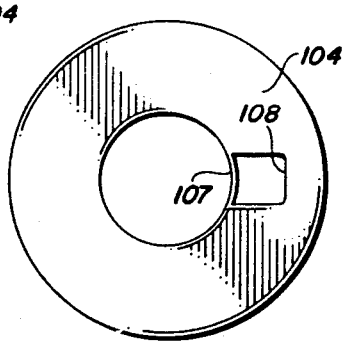
FIG. 4
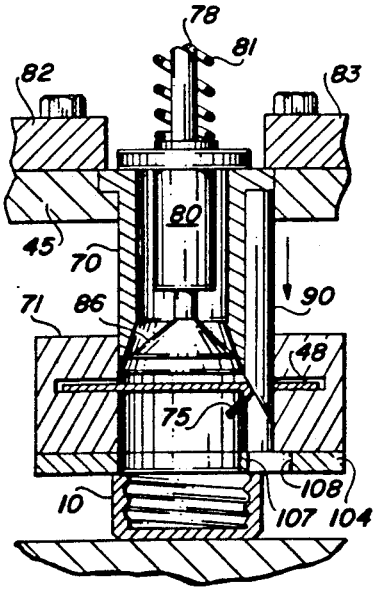
FIG. 1B
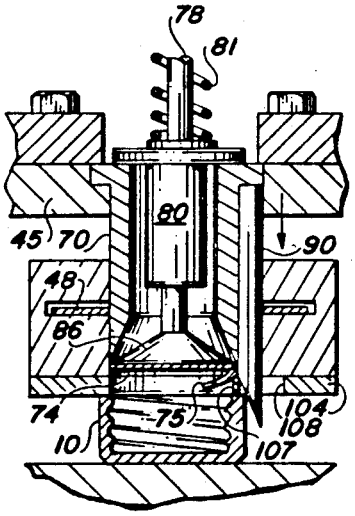
FIG. 1C
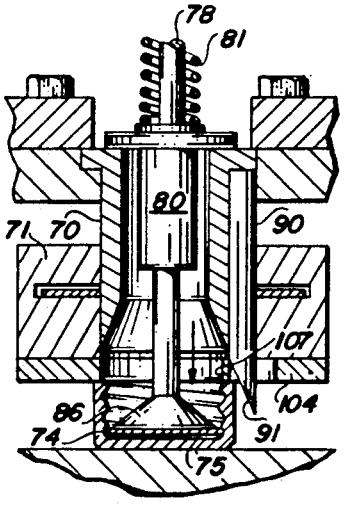
FIG. 1D

ONE STEP PULL TAB CAP-LINING MACHINE

BACKGROUND

Currently, many applications exist for providing tamper evident safety seals on the tops of bottles containing a variety of different products. Aluminum foil seals commonly are used for sealing such bottles containing petroleum products, food products, medicines, etc.. The aluminum foil seal is adhered to the upper end of the bottle neck, and the seal usually is formed from a liner comprising a laminate of aluminum bonded to a suitable polymer which may be induction heat sealed to the top of the bottle. Once the seal is in place, the seal insures that no foreign materials subsequently enter the bottle after it has been sealed and prior to its ultimate use. A second important purpose is that if tampering is attempted, the seal must be altered or destroyed because access to the interior of the bottle cannot be accomplished without doing this.

While such tamper evident seals serve the intended purpose of protecting the bottle contents from unauthorized access, they are difficult to remove. Generally, it is necessary to use a knife or other sharp object to break the seal and tear it away from the edge of the bottle neck. This usually leaves a ragged opening around the edge of the bottle and sometimes results in a spilling of some of the contents of the bottle during the efforts to remove the seal.

U.S. Pat. No. 4,754,890 to Ullman discloses a seal and a machine for making it which forms a tab or protuberance on the edge of the seal. This tab projects upwardly from the seal when the cap is removed from the top of the bottle. The tab then may be grasped by the user to peel the seal off the top of the bottle. The tab and seal formed by the device of the Ullman Patent are formed in a single punch operation, but it is necessary first to fold the foil material under itself along both edges prior to the punch operation. The punch then extends past this folded portion to form a folded under tab at the time the cap insert is made. Thus, it is necessary to provide separate apparatus to fold under the edges of the foil strip from which the seals are formed. A problem also exists in maintaining the precise alignment necessary to insure that the tab is not cut off and that it is of sufficient strength to prevent it from being torn away when the seal is to be removed from the bottle. In addition, forming the tab in this manner causes a flat edge to be also formed on the seal itself, which limits the size of the tab which can be formed. It is difficult to maintain the necessary alignment to overcome these problems.

Two other patents which disclose the need for providing a pull tab on a membrane cover over the opening in a metal can, are the Hardt U.S. Pat. No. 4,328,905 and Wright et al. U.S. Pat. No. 4,544,080. Neither of these patents, however, disclose the manner in which the tabs are formed.

Another technique which has been employed is to utilize progressive dies to first form a tab from a sheet of liner material passing through the liner insert machine. The tab is punched at a first position with a tab punch; and as the liner advances, the tab is folded under the liner material. This punched-folded tab then advances to the liner punch station where it is punched out as a part of the liner insert. Since the tab is folded under the insert, which then is inserted into a cap with the tab located between the cap and the liner, it subsequently can be utilized to remove the insert from a container on which the cap ultimately is attached. For a progressive die system of this type to work properly, the tab must be folded and creased without any defects, and then held folded until it reaches the liner insert punch station, alignment is tab is located at the liner insert punch station, alignment is critical. If the tab fold is not far enough into the punch station, the tab will be cut off. Also, if the tab is too far into the punch station, slits between the tab and the liner insert will result. These slits ultimately will cause the tab to tear away from the main liner insert when it is pulled to remove the insert from the container on which the insert ultimately is attached. This then leaves the main portion of the insert unremoved, with a rip or opening through it. Consequently, if significant precision is not maintained in such a progressive die system, faulty product results.

It is desirable to provide a cap-lining machine which produces pull tab liner insert disks which are not subject to the disadvantages of the prior art. Ideally, it is desirable to provide a one-step punch and die and insert operation to produce a tab liner insert seated in a cap, all as part of a single machine operation.

SUMMARY OF THE INVENTION

It is an object of this invention to provide an improved one-step tab liner insert forming machine.

It is another object of this invention to provide an improvement in the provision of a tamper evident safety seal having an attached tab to faciliate subsequent removal of the seal from the container on which it is placed.

It is an additional object of this invention to provide an improved cap lining machine.

It is a further object of this invention to provide an improved machine for producing a tamper evident insert seal with a grasping tab and for installing such seals in a cap.

In accordance with a preferred embodiment of the invention, a cap-lining machine produces tab liners and places such liners in a cap in a single step operation. To do this, the machine includes a stamping die with a first portion shaped to correspond with the internal size of a cap to be lined with a liner. A second smaller adjacent portion extends from the first portion and is shaped to form an extending pull tab, so that the two portions of the die together form a single opening in the die. A punch has first and second portions which mate, respectively, with the first and second portions of the die. The punch is moveable between retracted and punching positions to punch cap inserts with an extending tab on them from liner material located at the punching position The structure of the punch and the die is such that, during the punching operation, the tab first is cut and folded under the liner insert portion as the punch moves through its punching position. Once the liner with the attached tab has been punched, it is seated into a cap located beneath the punch as the final portion of the one-step punching and seating operation.

BRIEF DESCRIPTION OF THE DRAWING

FIG. 1A is a partially cut-away side view of a preferred embodiment of the invention in a first stage of operation;

FIGS. 1B through 1D illustrate a portion of the embodiment of FIG. 1 in three successive stages of operation;

FIG. 2 illustrates, a pull tab insert of the type formed by the apparatus of FIG. 1;

FIG. 3 is a view taken along the line 3—3 of FIG. 1; and

FIG. 4 is a view taken along the line 4—4 of FIG. 1 showing details of a portion of the apparatus of the embodiment of FIG. 1.

DETAILED DESCRIPTION

Reference now should be made to the drawing, in which the same reference numbers are used throughout the different figures to designate the same components. In addition, reference also should be made to the U.S. Pat. No. 4,728,239 to Kieran and Rickenbach, assigned to the same assignee as the present application. This patent illustrates a cap lining machine of a type which may be modified to incorporate the present invention and describes in greater detail the overall operation of a system for forming cap operation.

FIGS. 1A through 1D of the present application are similar in many respects to FIGS. 5A through 5C of U.S. Pat. No. 4,728,239, and those components which are substantially the same as the components of U.S. Pat. No. 4,728,239 have been given the same reference numbers in FIGS. 1A through 1D as they are given in FIGS. 5A through 5C of the '239 Patent. Reference should be made to the specification of U.S. Pat. No. 4,728,239 for a more complete description of the overall operation of the basic cap lining machine, and the specification of U.S. Pat. No. 4,728,239 is incorporated herein by reference.

Reference now should be made to FIG. 1A. In the operation of the machine described in U.S. Pat. No. 4,728,239, a cap 10, into which an insert is to be placed, first is centered directly beneath an opening 100 in a die 71, which is located beneath a punch block 45. In the retracted position shown in FIG. 1A, the punch block 45 and a punch comprising a first portion 70 and a second tab cutting portion 90, is located in the retracted position. Once the cap 10 is located as shown in FIG. 1A, the punch block 45 is lowered as described in the '239 Patent, to punch out a liner insert. The sequence of operation for accomplishing this is shown in FIGS. 1A, 1B, 1C, and 1D.

The punch portions 70 and 90 move downwardly together from the position shown in FIG. 1A first to the position shown in FIG. 1B. As illustrated in FIG. 1B, the tab cutting portion 90 of the punch first enters into a tab opening 101 in the die 71 to cut a tab 75 from a web 48 of the liner material. The side of the punch portion 90 which faces the main cap insert opening 100 in the die 71 is tapered at a relatively sharp angle 91 to cause the tab 75 which is cut by the punch 90 to curl toward the left, as viewed in FIG. 1B, as the punch block 45 moves downwardly to effect the punching operation.

The punch block 45 continues its downward movement to the final punching position shown in FIG. 1C. In this position, it can be seen that the punch portion 70, cooperating with the circular aperature 100 in the die 71, causes a circular cap liner insert 74 to be cut from the web 48. The punch carries the liner insert 74 and the curled under tab 75 to a position where it engages the upper edge of a circular opening in a folding member 104 attached to the bottom of the die 71. This folding member 104 is not present in the device of U.S. Pat. No. 4,728,239, and it has a cross section as illustrated in FIG. 4.

It can be seen that there is a circular opening in the member 104 which conforms with and is aligned with the opening 100 in the die 71. In addition, there is a second opening 108 which permits the cutting tip of the punch portion 90 to pass through it as the punch continues the downward movement shown in FIG. 1C. The two openings in the member 104 are joined by a folding rib 107.

The folded edge of the liner insert, where the tab 75 joins the main body portion 74 of the insert, engages the thin folding rib 107 to crease the tab 75 firmly underneath the main body portion 74 of the insert. This is illustrated in FIG. 1C which shows the folded edge of the tab 75 engaging the top of the folding rib 107. Also, it is readily apparent from an examination of FIG. 1C that once the punch block 45 has reached this lowermost position, the cutting end of the punch portion 90 is inserted through the opening 108 in the folding member 104.

In the position shown in FIG. 1C, the liner insert 74 with its connected tab 75 is located adjacent the lower edge of the die block 71 and above the open top of the cap 10. This location also is significantly above the bottom of the cap 10 into which the insert 74 is to be pressed.

As described in U.S. Pat. No. 4,728,239, placement of the liner inserts 74 in the cap 10 is accomplished by means of a reciprocating tamper 86 attached to a shaft 78. The tamper shaft 78, which terminates in the tamper 86, is concentrically mounted in a cartridge 80 located within the hollow punch 70. A flange on the top of the cartridge 80 extends outwardly over the upper end of the punch 70 for support; and the tamper shaft 78 is spring biased to an upward or retracted position by a spring 81, as best illustrated in FIG. 1A. The compression spring 81 extends between the top of the cartridge 80 and a circular flange attached to the upper end of the tamper shaft 78. The flange on the upper end of the tamper 78 then engages the end of a rocker arm 64.

The rocker arm 64 is attached to a shaft 63 which is mounted for a rotation between a pair of rocker arm support blocks (not shown here, but described in U.S. Pat. No. 4,728,239). One end of the shaft 63 extends through a bearing block 60 where it is attached to an operating lever arm 68 extending to the left of the shaft 64, as viewed in FIG. 1A. The outer end of the lever 68 has a removable projection 66 mounted on it. The projection 66 extends to one side (out of the surface of the paper, as illustrated in FIG. 1A) over a plunger 84 mounted in an air cylinder 79 attached to a common base plate (not shown) for the apparatus.

When the punch block 45 is in its retracted position, as shown in FIG. 1A, the projection 66 is located in a position just touching or spaced slightly above the end of the plunger 84. As a punch block 45 is drawn downwardly to commence and complete the punching cycle, the projection 66 engages the end of the plunger 84 causing the rocker arm, comprising the lever arms 68 and 64, to rotate in a clockwise direction about the shaft 63. The ratio of the length of the lever arm 68 to that of the arm 64 is approximately 1:2. This causes the right-hand end of the lever 64 to move the upper end of the tamper rod 78 downwardly against the bias of the spring 81 at a rate and to a distance twice that of the downward movement of the punch 70, 90. As the punch portion 70 completes the severance of the insert liner 74 from the web 48, the enlarged end 86 of the tamper 78 engages the top side of the liner insert 74, as shown most clearly in FIG. 1C. Continuation of the downward movement of the punch 70 and tamper 78 against the bias of the spring 81, however, causes the tamper 78 to move the portion 86 past the end of the punch 70, as indicated in FIG. 1D.

Completion of the movement of the tamper head 86 through the operation of the rod 78, to firmly seat the insert 74 (with the tab 75 folded under it) in the cap 10, is effected by operation of the air cylinder 79 to push the plunger 84 upwardly upon termination of the downward movement of the punch block 45. The air cylinder 79 and plunger 84 also act as a gas spring to effect cushioned seating of the liner 74 in the cap 10. This "gas spring" also absorbs the consequences of an upside down cap or jam up without damage to the machine.

The punch block 45 then is raised from the position shown in FIG. 1D back to the retracted position shown in FIG. 1A by any suitable manner, such as described in U.S. Pat. No. 4,728,239. The machine then is ready to commence another cycle of operation, following the movement of a new cap 10 into position beneath the apparatus as shown in FIG. 1A.

When the cap 10, with its liner insert 74 in place, as shown in FIG. 1D, is moved out of the punch mechanism, it is ready to be installed on the upper end of a container, such as a glass or plastic bottle neck. It is readily apparent from the foregoing description that the sealing liner insert 74 initially is independent of the bottle and is ready to be shipped to a bottler, where it subsequently is assembled mechanically to the bottle. The sealing liner insert is captured in the bottle cap 10, so that it can be handled in any suitable manner. Typically, the sealing liner, as described previously, is a sandwich of aluminum foil bonded to a mylar backing. The mylar backing side of this sandwich faces the open end of the cap 10.

After the bottler has filled the bottle or other container, the cap 10 is mechanically placed on the bottle and securely tightened in a conventional manner. The combined closure consisting of the cap 10 and sealing liner insert 74, with its attached tab 75, then is subjected to inductive heat, such as produced in a high frequency tunnel, to cause the mylar or other polymer to fuse to the upper end of the bottle neck to close the mouth of the bottle. This provides the desired tamper evident safety seal. When the cap 10 subsequently is removed by a customer, the aluminum foil side of the insert 74 is visible, and the laminated tamper evident seal is adhered to the bottle. The tab 75 then is visible to assist in subsequent removal of the seal 74.

Since the seal 74 and tab 75 are simultaneously formed in the manner described, there is no possibility of cutting off the tab 75 or forming slits or lines of weakening between the tab 75 and the seal 74. The operation simply and effectively forms the tab simultaneously with the liner insert 74, and in the same sequence of operation of the punch mechanism described in U.S. Pat. No. 4,728,239, completes the folding under of the tab 75 to a location which effectively presents it for non-interfering insertion into a cap 10.

The modifications to the punch and die mechanism of U.S. Pat. No. 4,728,239 to accomplish this purpose actually require very few additional parts. None of the basic operating mechanism of the punch and die mechanism of the '239 Patent needs to be changed. The die 71 is cut to include the tab opening 101; and the punch is modified to include the tab punching portion 90, with its inwardly sloped surface 91, as described previously. Finally, the only other addition is the folding ring 104, with the rib 107.

Various changes and modifications will occur to those skilled in the art without departing from the true scope of this invention as defined in the appended claims. The foregoing description of the apparatus, particularly as it is described in conjunction with a specific punch and die operating mechanism, is to be considered illustrative and not as limiting. The operation of the punch and die may be effected by various standard cam or gear operated mechanisms, as well as the one described in conjunction with the preferred embodiment, without departing from the scope of the invention.

I claim:

1. A cap-lining machine for producing tab liners and placing such liners in a cap in a single step operation, said machine including in combination:

a stamping die having a first portion shaped to correspond with the size of a cap to be lined with a liner, and a second smaller adjacent portion shaped to form an extending tab, said first and second portions together forming a single opening in said die;

a punch having first and second portions mating, respectively, with said first and second portions of said die, said punch moveable between retracted and punching positions for punching a cap insert with an extending tab thereon from a liner located at said punching position;

folding means in the form of a flat angled cam surface on the second portion of said punch for folding the extending tab punched from a liner by a second portion of said punch under the cap insert punched from a liner by the first portion of said punch as said punch moves through the punching position thereof; and a thin rib located beneath said die, and in a position between the first and second portions thereof, for engaging the edge of a folded-under extending tab as the second portion of said punch moves downwardly past said rib to complete the folding of said tab to a position underlying a cap insert formed from liner located at the punching position of said machine.

2. The combination according to claim 1 wherein the second portion of said punch moves into said second portion of said die prior to movement of said first portion of said punch through said first portion of said die as said punch is moved to the punching position thereof.

3. The combination according to claim 2 wherein said second portion of said punch extends downwardly below said first portion thereof, with said second portion having a cam surface thereon facing said first portion thereof, so that when said punch is moved from the retracted to the punching position thereof, said second portion cooperating with said second portion of said die forms said extending tab, and the cam surface of said second portion of said punch causes such extending tab to be curled under a liner cap insert formed from a liner by said first portion of said punch and said first portion of said die.

4. The combination according to claim 1 further including tamper means for seating cap inserts with folded under tabs thereon into caps located beneath the punch when said punch is in the punching position thereof.

5. The combination according to claim 4 wherein at least the first portion of said punch has a hollow body, with openings in the top and bottom thereof; and said tamper means comprises a tamper assembly inserted into the hollow body of said punching means, with a tamper member moveable from a retracted position relative to said punch to an extended position, wherein a portion of said tamper member extends below the bottom of both of said first and second portions of said punch when said punch has completed movement to the punching position thereof for pushing cap inserts formed by said machine into a cap located beneath the punch to seat a cap insert in such a cap with the tab thereon located between the cap insert and the cap.

6. The combination according to claim 5 wherein said tamper member is spring biased to a retracted position within said punch above the bottom thereof when said punch is in its retracted position; and further including means for moving said tamper member to its extended position to overcome said spring bias to extend said tamper member downwardly beyond the bottom of said punch with said punch in the punching position thereof.

7. The combination according to claim 1 wherein said second portion of said punch extends downwardly below said first portion thereof, with said second portion having a cam surface thereon facing said first portion thereof, so that when said punch is moved from the retracted to the punching position thereof, said second portion cooperating with said second portion of said die forms said extending tab, and the cam surface of said second portion of said punch causes such extending tab to be curled under a liner cap insert formed from a liner by said first portion of said punch and said first portion of said die.

8. The combination according to claim 7 further including tamper means for seating cap inserts with folded under tabs thereon into caps located beneath the punch when said punch is in the punching position thereof.

* * * * *